US010130203B2

(12) United States Patent
Yoo

(10) Patent No.: US 10,130,203 B2
(45) Date of Patent: Nov. 20, 2018

(54) CUP WITH MOBILE DEVICE SUPPORT

(71) Applicant: Hyo Sang Yoo, Incheon (KR)

(72) Inventor: Hyo Sang Yoo, Incheon (KR)

( * ) Notice: Subject to any disclaimer, the term of this patent is extended or adjusted under 35 U.S.C. 154(b) by 0 days.

(21) Appl. No.: 15/326,067

(22) PCT Filed: Apr. 29, 2015

(86) PCT No.: PCT/KR2015/004282

§ 371 (c)(1),
(2) Date: Jan. 13, 2017

(87) PCT Pub. No.: WO2016/010240

PCT Pub. Date: Jan. 21, 2016

(65) Prior Publication Data

US 2017/0202386 A1 Jul. 20, 2017

(30) Foreign Application Priority Data

Jul. 14, 2014 (KR) ..... 10-2014-0088466

(51) Int. Cl.

| | |
|---|---|
| ***B65D 25/00*** | (2006.01) |
| ***A47G 29/00*** | (2006.01) |
| ***A47G 19/22*** | (2006.01) |
| ***B65D 1/02*** | (2006.01) |
| ***B65D 25/20*** | (2006.01) |
| ***B65D 25/28*** | (2006.01) |

(Continued)

(52) U.S. Cl.

CPC ..... *A47G 29/00* (2013.01); *A45F 5/102* (2013.01); *A47G 19/22* (2013.01); *A47G 19/2205* (2013.01); *A47G 19/2261* (2013.01); *A47G 23/0216* (2013.01); *B65D 1/023* (2013.01); *B65D 25/20* (2013.01); *B65D 25/2885* (2013.01); *B65D 41/02* (2013.01); *B65D 43/02* (2013.01); *A45F 2200/0516* (2013.01)

(58) Field of Classification Search

CPC ..... A47G 29/00; A47G 19/2261; A47G 19/2205; A47G 23/0216; A47G 19/22; A45F 5/102; A45F 2200/0516; B65D 25/20; B65D 25/2885; B65D 1/023; B65D 43/02; B65D 41/02

USPC ..... 220/752–776, 710.5, 696, 741

See application file for complete search history.

(56) References Cited

U.S. PATENT DOCUMENTS 556,337 A * 3/1896 Dawes ..... A47G 23/0266 220/737
2,493,751 A * 1/1950 Davis ..... B44D 3/123 131/257

(Continued)

FOREIGN PATENT DOCUMENTS

CN 203608994 U 5/2014
KR 20-2012-0008588 U 12/2012

(Continued)

*Primary Examiner* — Kareen Thomas
(74) *Attorney, Agent, or Firm* — KORUS Patent, LLC; Seong Il Jeong

(57) ABSTRACT

In one aspect, there is provided a cup with mobile device support, the cup comprising: a container body having an inner space to receive content; a grip coupled to the container body, wherein the grip extends downwards inclinedly and has a holding portion at a lower end thereof, wherein the holding portion is structured to hold and stop a mobile device thereon, wherein the holding portion extends upwardly.

6 Claims, 15 Drawing Sheets

(51) Int. Cl.

| | |
|---|---|
| ***B65D 41/02*** | (2006.01) |
| ***B65D 43/02*** | (2006.01) |
| ***A45F 5/10*** | (2006.01) |
| ***A47G 23/02*** | (2006.01) |

(56) References Cited

U.S. PATENT DOCUMENTS

| | | | | | |
|---|---|---|---|---|---|
| 5,020,755 | A | | 6/1991 | Frankel | |
| 5,984,136 | A | * | 11/1999 | Mason | A47G 23/0225 220/23.83 |
| 6,059,138 | A | * | 5/2000 | Labruyere | A47G 23/0225 220/23.4 |
| 6,719,951 | B1 | * | 4/2004 | Griffith | A61B 10/007 215/396 |
| D583,933 | S | * | 12/2008 | Finney | D24/121 |

FOREIGN PATENT DOCUMENTS

| | | | |
|---|---|---|---|
| KR | 20-2012-0008827 | U | 12/2012 |
| KR | 10-2013-0001825 | A | 1/2013 |

* cited by examiner

CUP WITH MOBILE DEVICE SUPPORT

BACKGROUND

Field of the Present Disclosure

The present disclosure relates to a cup with a grip with mobile device support function.

Discussion of Related Art

In recent years, due to the development of information and communication technology, it has been widely used for viewing media including a variety of moving pictures as well as Internet search through a mobile device.

When watching videos through a mobile device, it is preferable to place the mobile device at a comfortable angle.

However, it is somewhat inconvenient to carry a separate mobile device support at all times.

A prior art mobile device support is disclosed in Korean Patent Application Publication No. 10-2013-0080201.

SUMMARY

The present disclosure is to provide a cup with mobile device support which is easily carried.

In one aspect, there is provided a cup with mobile device support, the cup comprising: a container body having an inner space to receive content; a grip coupled to the container body, wherein the grip extends downwards inclinedly and has a holding portion at a lower end thereof, wherein the holding portion is structured to hold and stop a mobile device thereon, wherein the holding portion extends upwardly.

In one implementation, the grip has a width above 15 mm, preferably, in a range of 20 to 40 mm.

In one implementation, the cup further comprises a bottom support extending from a lower level of the body horizontally in a direction of the grip.

In one aspect, there is provided a cup with mobile device support, the cup comprising: a container body having an inner space to receive content; a removable mobile device support removably coupled to the container body, wherein the removable mobile device support includes: a coupler removably coupled to the body and a grip coupled to the coupler, wherein the grip extends downwards inclinedly and has a holding portion at a lower end thereof, wherein the holding portion is structured to hold and stop a mobile device thereon, wherein the holding portion extends upwardly.

In one implementation, the coupler is structured to wrap the container body or to be inserted into an open top of the container body.

In accordance with the present discourse, a separate mobile device support should not be carried. The mobile device support is removable from the container body which is further easily carried. The level of the support is adjusted to allow the viewer to view the display in the mobile device more comfortably.

REFERENCE NUMERALS

Figure 1:
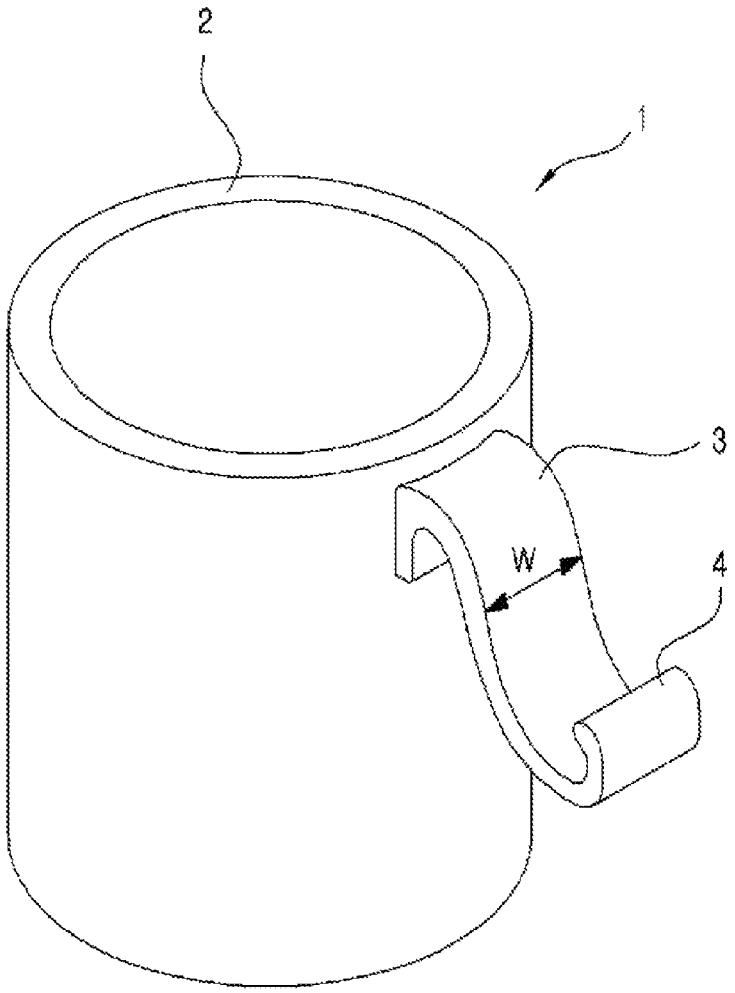
FIG. 1 is a perspective view of a cup with mobile device support in accordance with a first embodiment of the present disclosure.

1, 11, 21, 31, 41, 51, 71 cup
2, 12, 22, 32, 42, 72 container body
3, 13, 23, 33 grip
4, 14, 24, 5*b*, 7*b*, 8*b* holding portion
15 connection portion
34 bottom support
61, 81 bottle
5, 7, 8 removable mobile device support
5*a*, 7*a* coupler
5*c* gap
7*c*, 8*c* top cover
82 neck

DETAILED DESCRIPTIONS

Hereinafter, various embodiments of a cup with mobile device support will be described in details with reference to the attached drawings.

Figure 2:
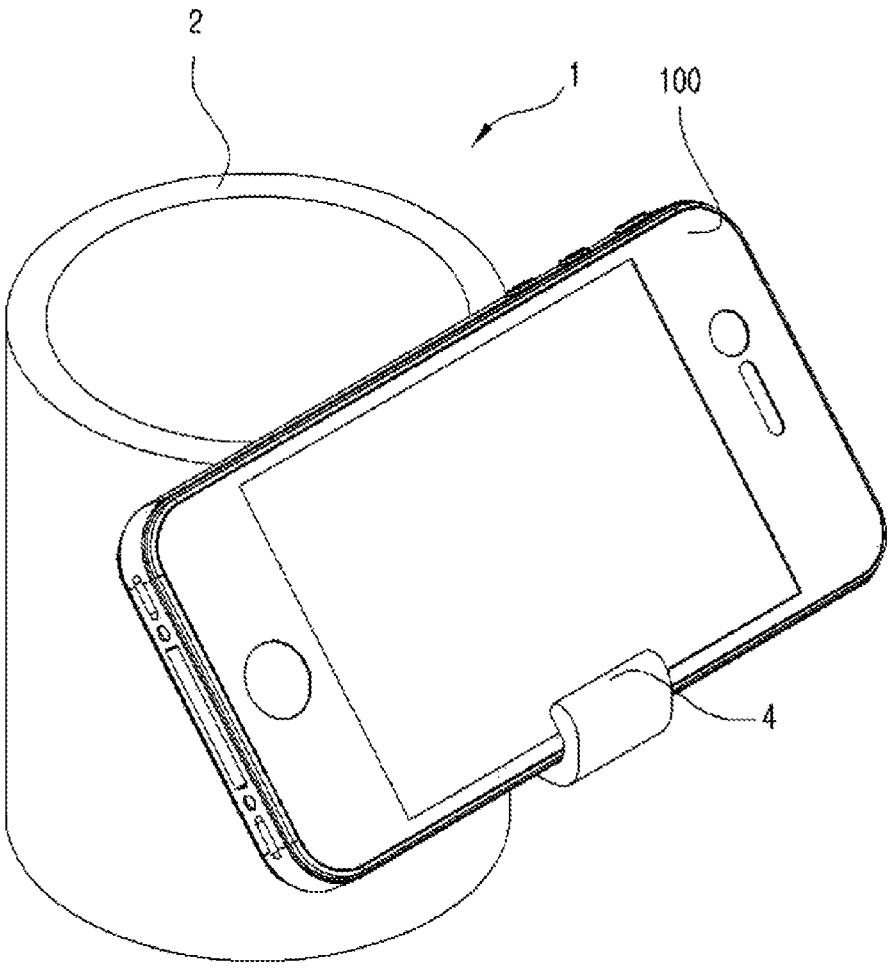
FIG. 2 is a perspective view of a cup with mobile device support in accordance with a first embodiment of the present disclosure when a mobile device is supported by the cup.
Figure 3:
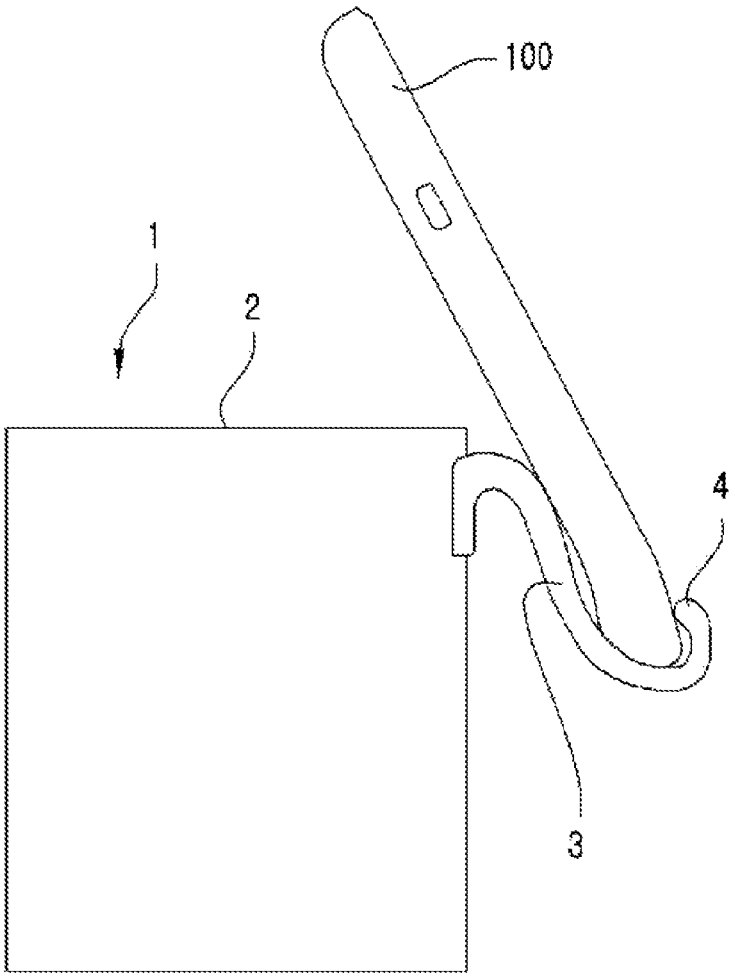
FIG. 3 is a side elevation view of a cup with mobile device support in accordance with a first embodiment of the present disclosure when a mobile device is supported by the cup.

FIG. 1 is a perspective view of a cup with mobile device support in accordance with a first embodiment of the present disclosure. FIG. 2 is a perspective view of a cup with mobile device support in accordance with a first embodiment of the present disclosure when a mobile device is supported by the cup. FIG. 3 is a side elevation view of a cup with mobile device support in accordance with a first embodiment of the present disclosure when a mobile device is supported by the cup.

Referring to FIG. 1 to FIG. 3, a cup 1 with mobile device support in accordance with a first embodiment of the present disclosure may include a container body 2 to receive therein liquid content and a grip 3 coupled to the container body 2.

The container body 2 may have an inner space defined therein. The container body 2 may have a cylindrical shape. The present disclosure is not limited thereto. The container body 2 may have a square pillar, triangular pillar or polygonal pillar shape having an inner space defined therein.

The grip 3 is formed on the outer face of the container body 2 and is used to hold the container body 2 and to support a mobile device 100. The grip 3 has a width W of at least 15 mm, preferably between 20 and 40 mm, so as to ensure sufficient support area to prevent the mobile device 100 from falling to the left and right of the grip 3 when the mobile device 100 is mounted on the grip 3. At the end of the grip 3, a holding portion 4 protruding upward is formed. The holding portion 4 of the grip 3 functions to prevent the mobile device 100 from slipping off the grip 3 by holding the bottom of the mobile device 100 when the mobile device 100 is mounted thereon. The grip 3 has a shape inclined downwardly at a predetermined angle from an upper end to a lower end in which the holding portion 4 is formed. In this way, as shown in FIG. 2 and FIG. 3, when the mobile device 100 is mounted thereon, the mobile device 100 is slightly tilted.

The container body 2 and the grip 3 are preferably made of a ceramic material or a glass material such that the cup 1 has a sufficient weight not to fall down in a direction of the grip 3 when the mobile device 100 is mounted on the holding portion. However, the material of the cup 1 is not necessarily limited to a ceramic material or a glass material.

Figure 4:
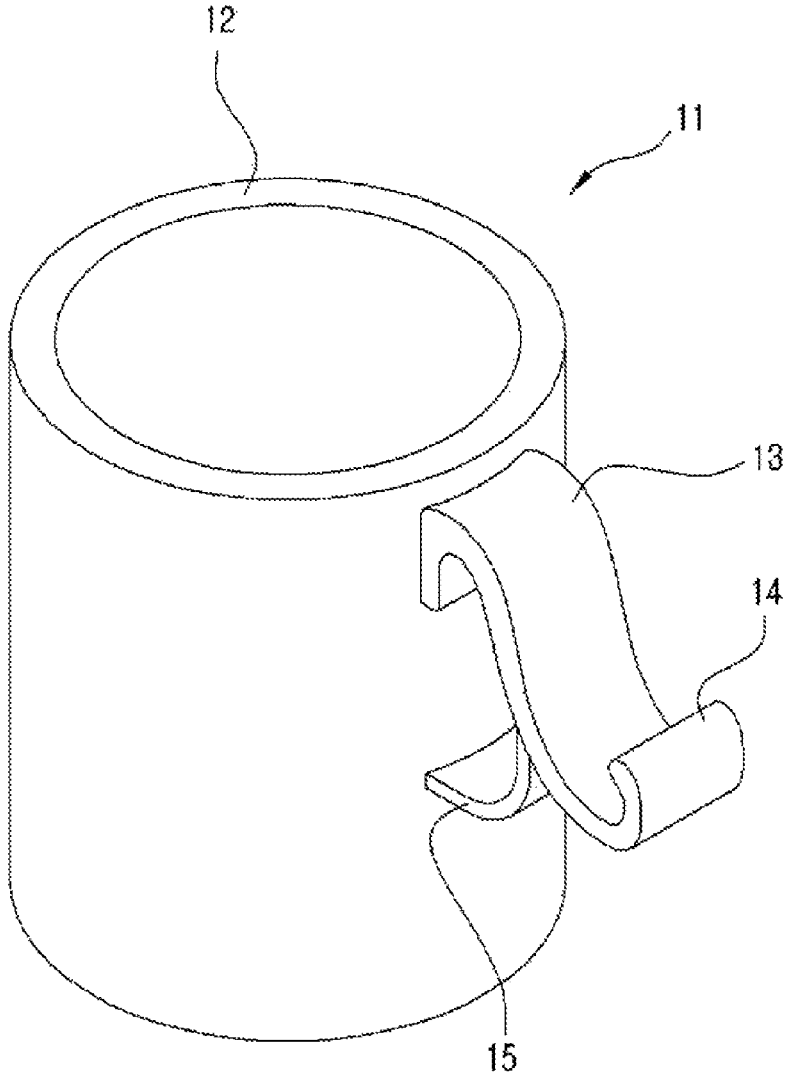
FIG. 4 is a perspective view of a cup with mobile device support in accordance with a second embodiment of the present disclosure.

FIG. 4 is a perspective view of a cup with mobile device support in accordance with a second embodiment of the present disclosure.

Referring to FIG. 4, a cup 11 with mobile device support in accordance with a second embodiment of the present disclosure may include a container body 12 to receive therein liquid content and a grip 13 coupled to the container body 12. The container body 12 may have an inner space defined therein. The container body 12 may have a cylindrical shape. The present disclosure is not limited thereto. The container body 12 may have a square pillar, triangular pillar or polygonal pillar shape having an inner space defined therein. The grip 13 is formed on the outer face of the container body 12 and is used to hold the container body 12 and to support a mobile device 100. At the end of the grip 13, a holding portion 14 protruding upward is formed. The holding portion 14 of the grip 13 functions to prevent the mobile device 100 from slipping off the grip 13 by holding the bottom of the mobile device 100 when the mobile device 100 is mounted thereon. The grip 13 has a shape inclined downwardly at a predetermined angle from an upper end to a lower end in which the holding portion 14 is formed. The cup 11 may further have a connection portion 15 to connect a lower portion of the container body 12 and the grip 13 to form a ring structure consisting of a portion of the container body 12 between the upper end of the grip 13 and a lower end of the connection portion 15 and a portion of the grip 13 and the connection portion This ring structure may allow the user to grip the grip 13 securely because the user's finger is not easily deviated from the ring structure as long as the user dose not stretch the finger.

Figure 5:
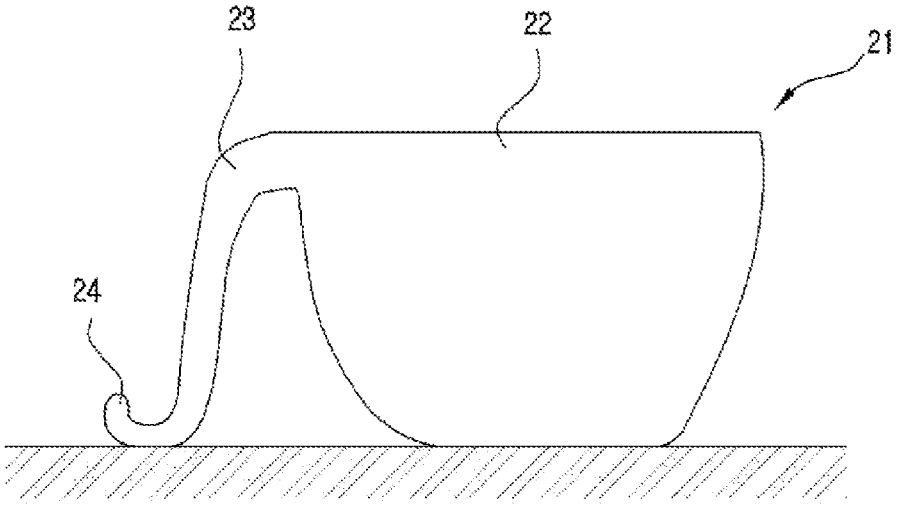
FIG. 5 is a side elevation view of a cup with mobile device support in accordance with a third embodiment of the present disclosure.

FIG. 5 is a side elevation view of a cup with mobile device support in accordance with a third embodiment of the present disclosure.

Referring to FIG. 5, a cup 21 with mobile device support in accordance with a third embodiment of the present disclosure may include a container body 22 to receive therein liquid content and a grip 23 coupled to the container body 22. The container body 22 may have an inner space defined therein. The container body 22 may have a cylindrical shape. The present disclosure is not limited thereto. The container body 22 may have a square pillar, triangular pillar or polygonal pillar shape having an inner space defined therein. The grip 23 is formed on the outer face of the container body 22 and is used to hold the container body 22 and to support a mobile device 100. At the end of the grip 23, a holding portion 24 protruding upward is formed. The holding portion 24 of the grip 23 functions to prevent the mobile device 100 from slipping off the grip 23 by holding the bottom of the mobile device 100 when the mobile device 100 is mounted thereon. The grip 23 has a shape inclined downwardly at a predetermined angle from an upper end to a lower end in which the holding portion 24 is formed.

In this embodiment, the lower end of the grip 23 in which the holding portion 24 is formed is substantially flush with a bottom of the container body 22. In this way, when the grip 23 supports the mobile device 100 thereon, the cup 21 may be prevented from falling down in a direction of the grip 23.

Figure 6:
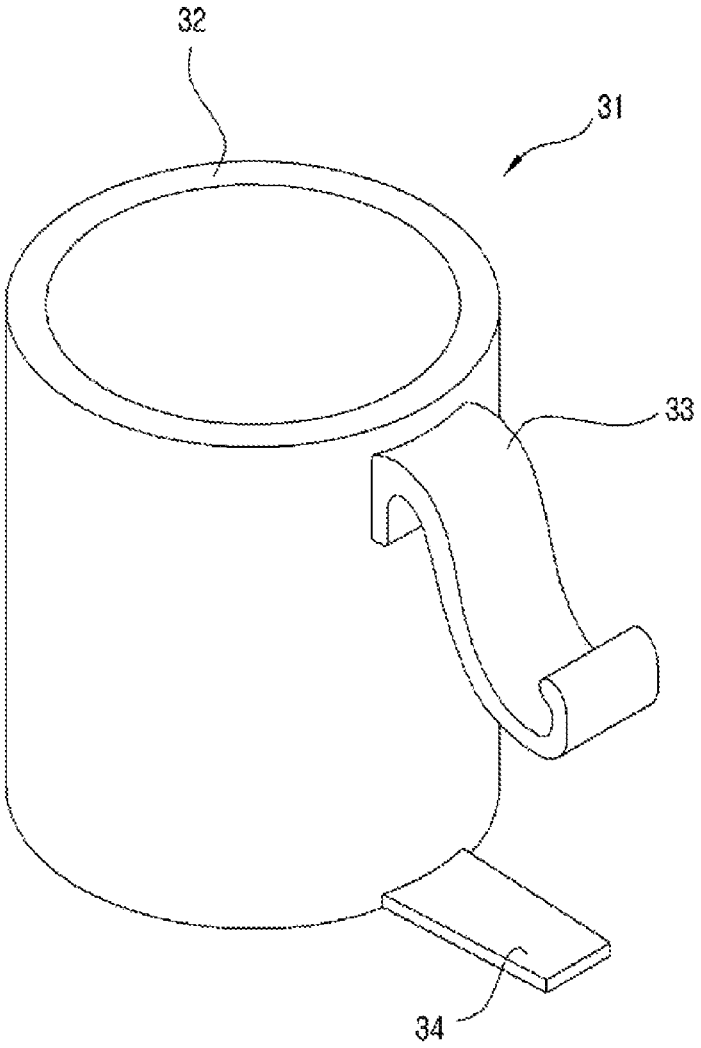
FIG. 6 is a perspective view of a cup with mobile device support in accordance with a fourth embodiment of the present disclosure.

FIG. 6 is a perspective view of a cup with mobile device support in accordance with a fourth embodiment of the present disclosure.

Referring to FIG. 6, a cup 31 with mobile device support in accordance with a fourth embodiment of the present disclosure may include a container body 22 to receive therein liquid content and a grip 23 coupled to the container body 22. The container body 22 may have an inner space defined therein. The container body 22 may have a cylindrical shape. The present disclosure is not limited thereto. The container body 32 may have a square pillar, triangular pillar or polygonal pillar shape having an inner space defined therein. The grip 33 is formed on the outer face of the container body 32 and is used to hold the container body 32 and to support a mobile device 100. At the end of the grip 33, a holding portion protruding upward is formed. The holding portion of the grip 33 functions to prevent the mobile device 100 from slipping off the grip 33 by holding the bottom of the mobile device 100 when the mobile device 100 is mounted thereon. The grip 33 has a shape inclined downwardly at a predetermined angle from an upper end to a lower end in which the holding portion is formed In this embodiment, in order to prevent the container body 32 from falling down in the direction of the grip 33 when the mobile device 100 is mounted on the grip 33, a bottom support 34 may extend horizontally in a direction of the grip 33 from a bottom portion of the container body 32.

However, the extension direction of the bottom support 34 is not limited to the direction of the grip 33. For example, the bottom support 34 may extend radially around the outer circumference of the container body from the bottom portion of the container body 32. It may suffice that the bottom support 34 contains the extension in the direction of the grip 33.

Figure 7:
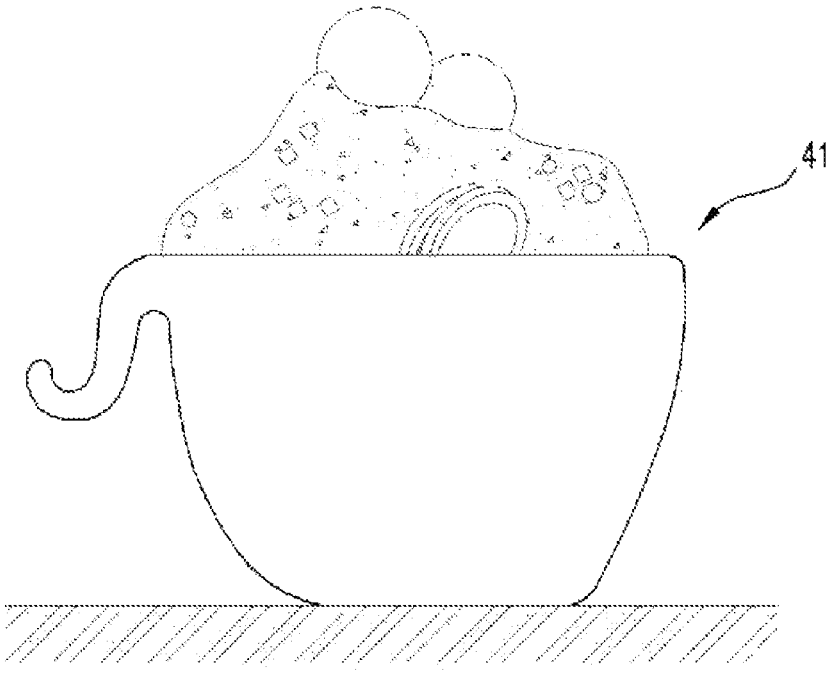
FIG. 7 is a side elevation view of a cup with mobile device support in accordance with an embodiment of the present disclosure where the cup contains therein ice shavings.

FIG. 7 is a side elevation view of a cup with mobile device support in accordance with an embodiment of the present disclosure where the cup contains therein ice shavings. As shown in FIG. 7, the cup with mobile device support in accordance with an embodiment of the present disclosure may be embodied to contain not only the liquid content but also solid content or solid and liquid mixed content such as ice shavings with red beans. In this example, the cup 41 contains the ice shavings with red beans. However, the present disclosure is not limited thereto.

Figure 8:
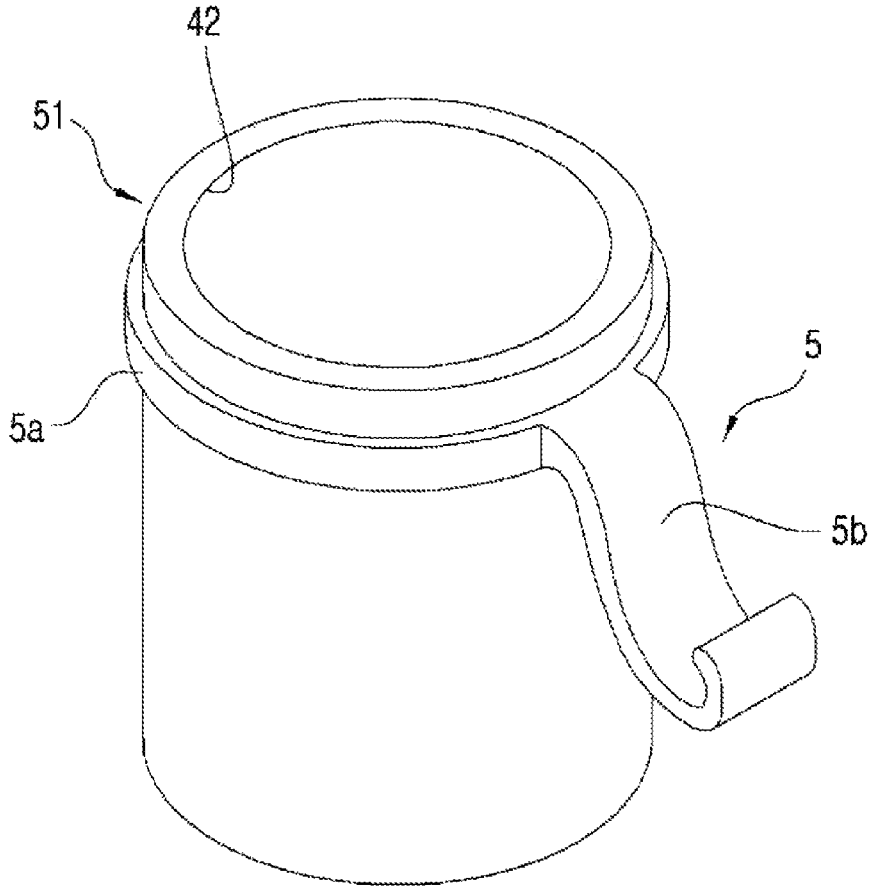
FIG. 8 is a perspective view of a cup with mobile device support in accordance with a fifth embodiment of the present disclosure.
Figure 9:
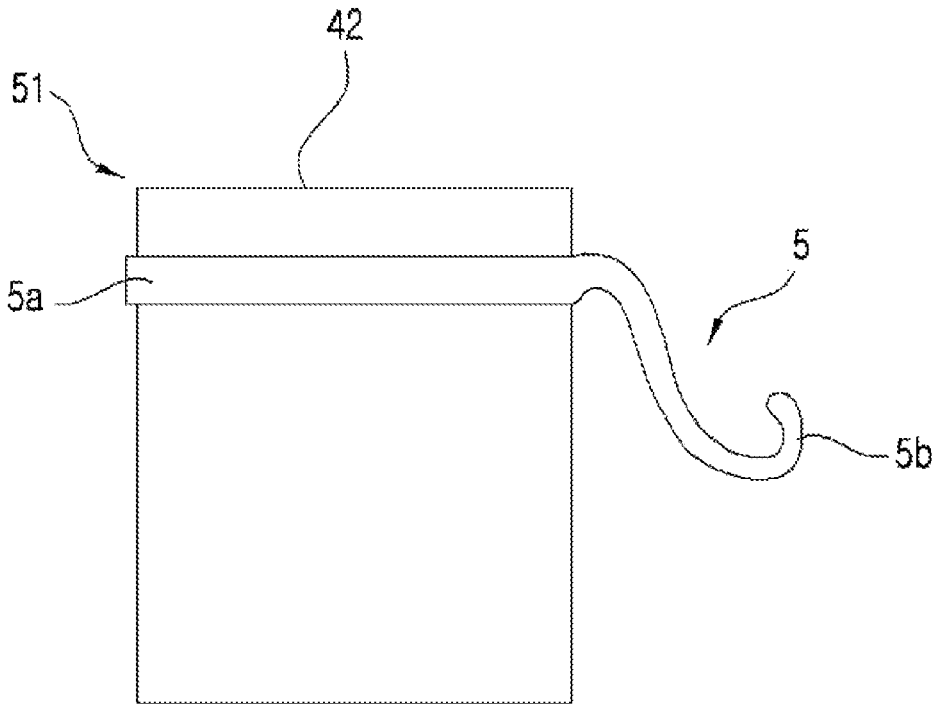
FIG. 9 is a side elevation view of a cup with mobile device support in accordance with a fifth embodiment of the present disclosure.
Figure 10:
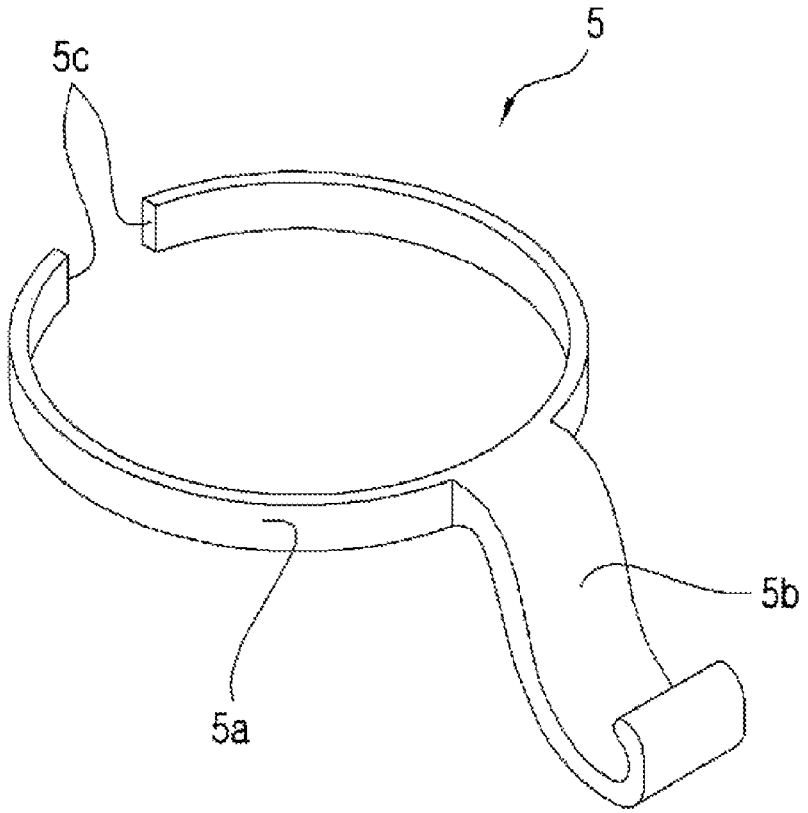
FIG. 10 is a perspective view of a removable mobile device support of a cup with mobile device support in accordance with a fifth embodiment of the present disclosure.
Figure 11:
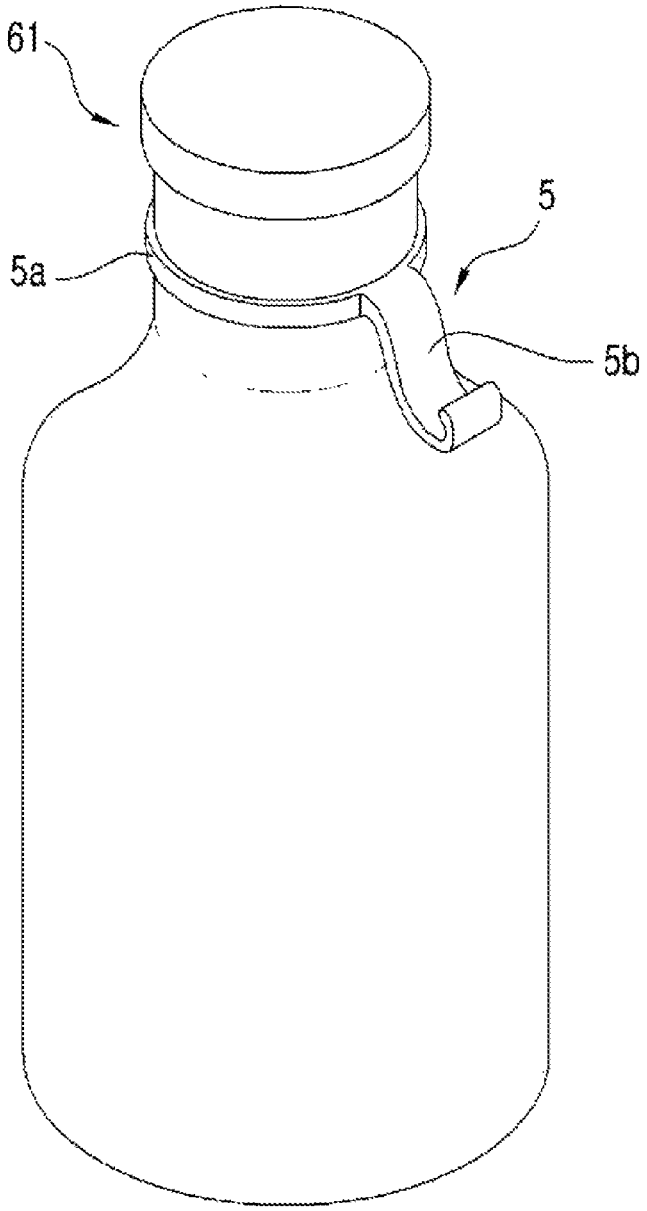
FIG. 11 is a perspective view of a bottle with a removable mobile device support in accordance with an embodiment of the present disclosure.

FIG. 8 is a perspective view of a cup with mobile device support in accordance with a fifth embodiment of the present disclosure. FIG. 9 is a side elevation view of a cup with mobile device support in accordance with a fifth embodiment of the present disclosure. FIG. 10 is a perspective view of a removable mobile device support of a cup with mobile device support in accordance with a fifth embodiment of the present disclosure. FIG. 11 is a perspective view of a bottle with a removable mobile device support in accordance with an embodiment of the present disclosure.

Referring to FIG. 8 to FIG. 10, a cup 51 with mobile device support in accordance with a fifth embodiment of the present disclosure includes a container body 42 and a removable mobile device support 5 removably coupled to the container body 42. The removable mobile device support 5 is removably coupled to the container body 42. The removable mobile device support 5 may have a holding portion 5*b* having the same structure as described above. The removable mobile device support 5 may be made of a stainless metal or plastic. The removable mobile device support 5 may include a coupler 5*a* and a holding portion 5*b*. The coupler 5*a* may be configured to wrap the container body 42. The coupler 5*a* may have an annular structure. A gap 5*c* may be defined in the annular structure to allow enlargement of a diameter of the annular structure when the coupler 5*a* is fitted with the container body 41.

When the user wishes to attach the removable mobile device support 5 to the cup 51, the coupler 5*a* wraps the container body 42. That is, both sides of the gap 5*c* of the coupler 5*a* are wider to allow enlargement of a diameter of the annular structure. Then, the enlarged annular structure is fitted with the circumference of the container body 42. The user may disconnect the coupler 5*a* from the cup 51 when the user does not need the removable mobile device support 5. In other words, since the removable mobile device support 5 is removable, it is possible to replace the cup 51 using the same removable mobile device support 5. Further, the fitting level of the removable mobile device support 5 with the container body 41 may be adjusted to allow the user to comfortably view the display in the mobile device 100 mounted on the mobile device support 5.

FIG. 11 is a perspective view of a bottle with a removable mobile device support in accordance with an embodiment of the present disclosure. The removable mobile device support 5 as described above may be equally applied to a bottle 61 as shown in FIG. 11. To be specific, the removable mobile device support 5 may be fitted with the neck portion of the bottle 61. The removable mobile device support 5 may have a holding portion 5*b* having the same structure as described above. The removable mobile device support 5 may be made of a stainless metal or plastic. The removable mobile device support 5 may include a coupler 5*a* and a holding portion 5*b*. The coupler 5*a* may be configured to wrap the neck portion of the bottle as shown in FIG. 11. The coupler 5*a* may have an annular structure. The gap 5*c* may be defined in the annular structure to allow enlargement of a diameter of the annular structure when the coupler 5*a* is fitted with the bottle 61. Further, the fitting level of the removable mobile device support 5 with the bottle 61 is not limited to the neck portion. Further, the fitting level of the removable mobile device support 5 with the bottle 61 may be adjusted to allow the user to comfortably view the display in the mobile device 100 mounted on the mobile device support 5.

Figure 12:
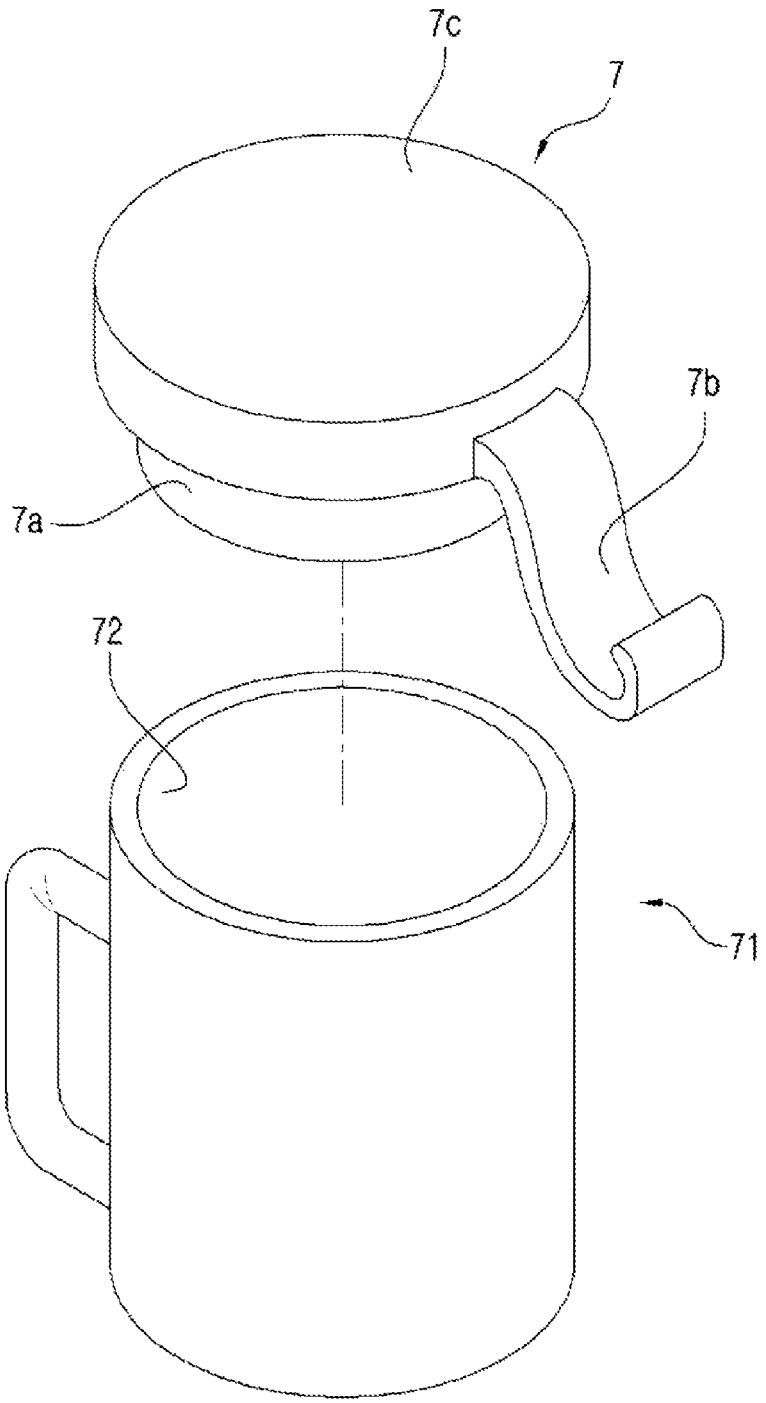
FIG. 12 is an exploded perspective view of a cup with mobile device support in accordance with a sixth embodiment of the present disclosure.
Figure 13:
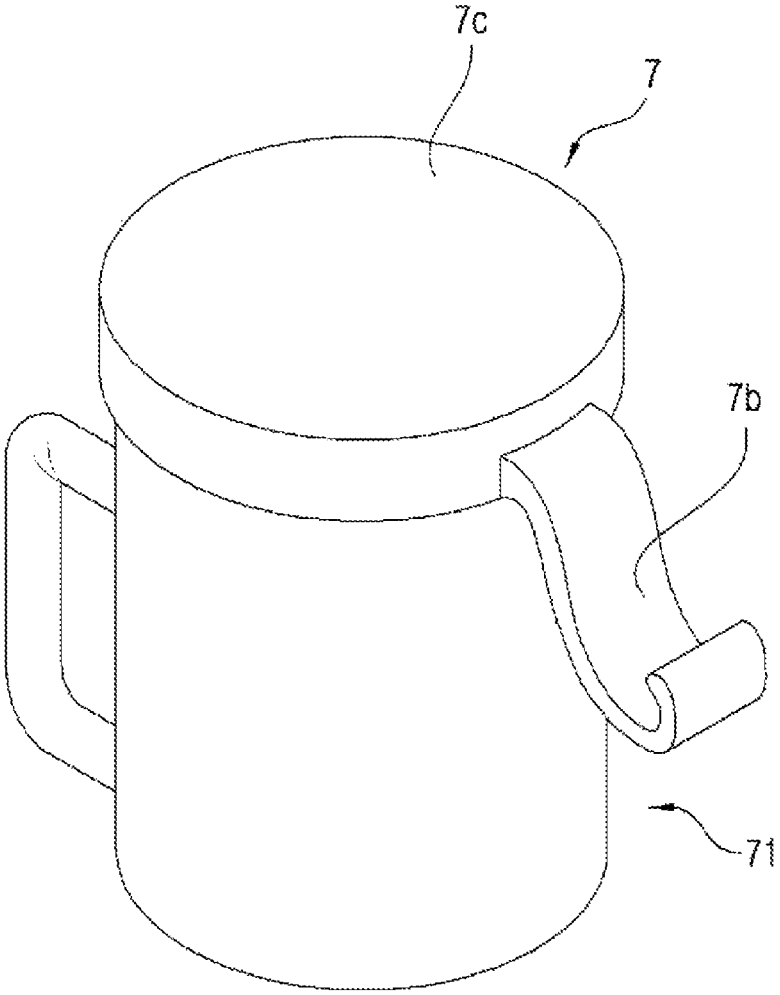
FIG. 13 is a perspective view of a cup with mobile device support in accordance with a sixth embodiment of the present disclosure.

FIG. 12 is an exploded perspective view of a cup with mobile device support in accordance with a sixth embodiment of the present disclosure. FIG. 13 is a perspective view of a cup with mobile device support in accordance with a sixth embodiment of the present disclosure.

Referring to FIG. 12 to FIG. 13, a cup 71 with mobile device support in accordance with a sixth embodiment of the present disclosure includes a container body 72 and a removable mobile device support 7 removably coupled to the container body 72. The removable mobile device support 7 is removably coupled to the container body 72. The removable mobile device support 7 may have a holding portion 7*b* having the same structure as described above. The removable mobile device support 7 may be made of a stainless metal or plastic. The removable mobile device support 7 may include a coupler 7*a* and a holding portion 7*b*. The coupler 7*a* may be configured to be inserted into an open top of the container body 72. The removable mobile device support 7 includes a top cover 7*c* coupled to the holding portion 7*b*. The top cover 7*c* may close the open top of the container body 72 when the coupler 7*a* is inserted into an open top of the container body 72. In this way, when the mobile device is held on the holding portion 7*b* and then the cup 71 falls down due to the weight of the mobile device, the content in the container body may not flow out of the container body.

Figure 14:
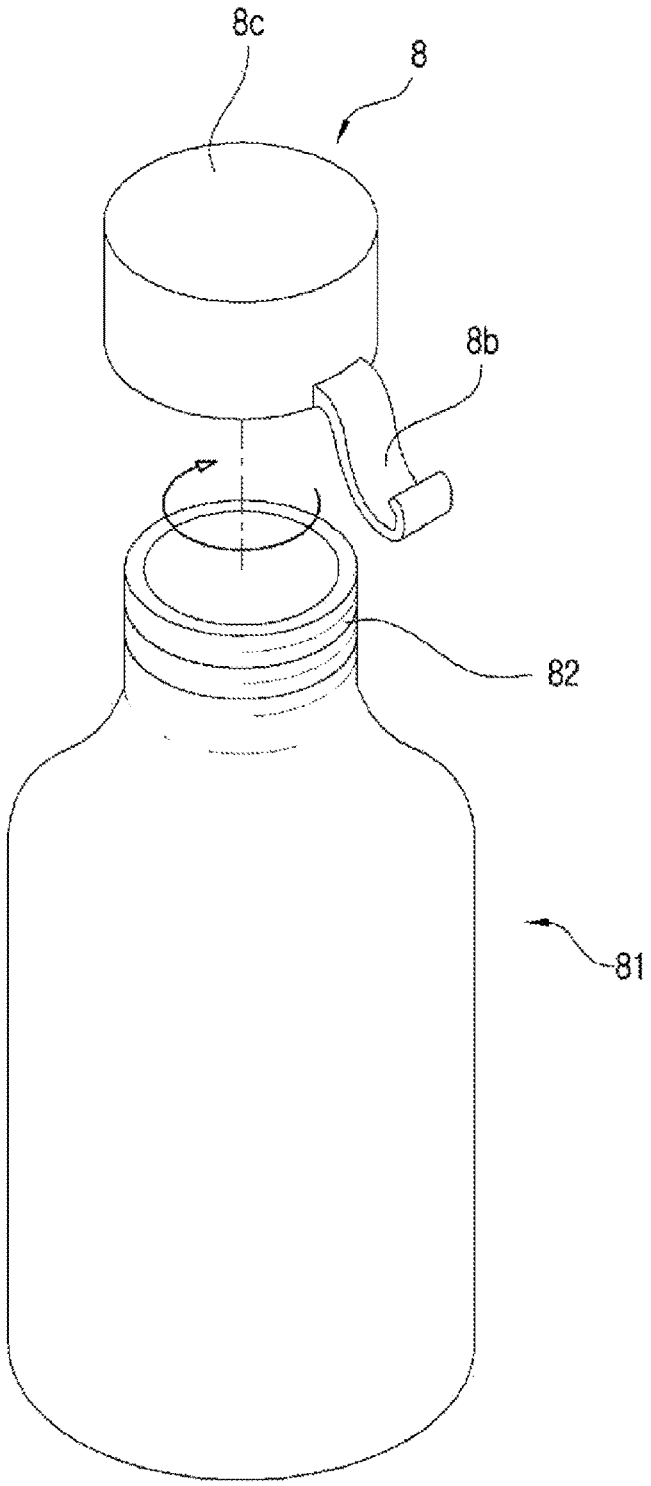
FIG. 14 is an exploded perspective view of a bottle with mobile device support in accordance with another embodiment of the present disclosure.
Figure 15:
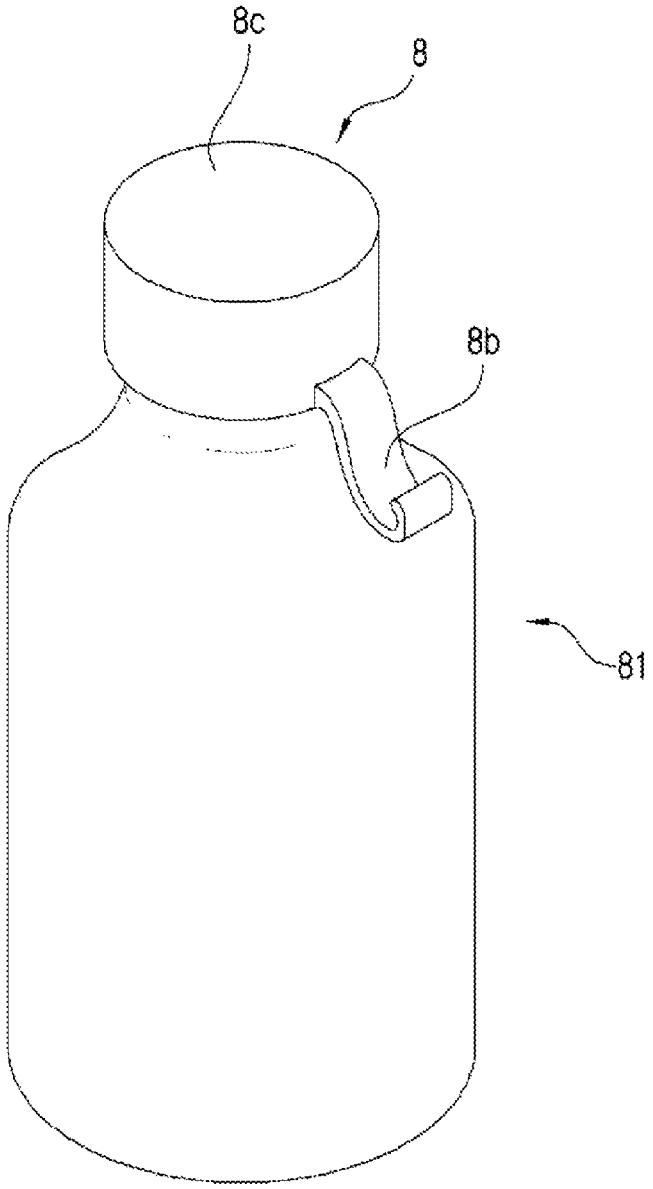
FIG. 15 is a perspective view of a bottle with mobile device support in accordance with another embodiment of the present disclosure.

FIG. 14 is an exploded perspective view of a bottle with mobile device support in accordance with another embodiment of the present disclosure. FIG. 15 is a perspective view of a bottle with mobile device support in accordance with another embodiment of the present disclosure.

As shown in FIG. 14 and FIG. 15, a bottle 81 with mobile device support in accordance with another embodiment of the present disclosure include a bottle body, a neck 82 having an open top and a bottle cap 8. The bottle cap 8 may act as the removable mobile device support as described above. The bottle cap 8*c* may be screw-coupled to the neck portion 82. The bottle cap 8 may have the mobile device support 8*b* formed on the outer face of the bottle cap 8 to support a mobile device 100. At the end of the mobile device support 8*b*, a holding portion protruding upward is formed. The holding portion of the mobile device support 8*b* functions to prevent the mobile device 100 from slipping off the mobile device support 8*b* by holding the bottom of the mobile device 100 when the mobile device 100 is mounted thereon. The mobile device support 8*b* has a shape inclined downwardly at a predetermined angle from an upper end to a lower end in which the holding portion is formed.

In use, the bottle cap 8*c* is coupled to the neck portion 82 of the bottle 81 and the mobile device is held on the holding portion of the mobile device support 8*b*. In this way, when the mobile device is held on the holding portion and then the bottle 81 falls down due to the weight of the mobile device, the content in the bottle body may not flow out of the body.

In the above detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various embodiments are illustrated and described further above. It will be understood that the description herein is not intended to limit the claims to the specific embodiments described. On the contrary, it is intended to cover alternatives, modifications, and equivalents as may be included within the spirit and scope of the present disclosure as defined by the appended claims.

What is claimed is:

1. A cup with mobile device support, the cup comprising:
a container body having an inner space to receive content;
a grip coupled to the container body, the grip extending downwards inclinedly from the container body the grip has a width in a range of 20 to 40 mm; and
a bottom support extending from a lower level of the container body horizontally in a direction of the grip,
wherein the grip comprises a holding portion at a lower end thereof, wherein the holding portion extends from the lower end upwardly and toward the container body, and is structured to hold a side of a mobile device thereon and prevent the mobile device from slipping off the grip by holding the side of the mobile device.

2. The cup of claim 1, wherein the grip is made of a stainless or plastic material and is removable from the container body.

3. The cup of claim 1, wherein the grip is structured to wrap the container body or to be inserted into an open top of the container body.

4. A cup with mobile device support, the cup comprising:
a container body having an inner space to receive content;
a removable mobile device support removably coupled to the container body,
wherein the removable mobile device support comprises:
a coupler removably coupled to the container body and
a grip coupled to the coupler, the grip extending downwards inclinedly from the coupler,
wherein the grip comprises a holding portion at a lower end thereof, the holding portion being extended from the lower end upwardly and toward the coupler, and structured to hold a side of a mobile device thereon and prevent the mobile device from slipping off the grip by holding the side of the mobile device, and
wherein the coupler is formed in a C-shaped structure to allow enlargement of a diameter of the C-shaped structure when the coupler is fitted with the container body.

5. The cup of claim 4, wherein the coupler is structured to wrap the container body.

6. The cup of claim 4, wherein the coupler is structured to be inserted into an open top of the container body.

* * * * *